United States Patent [19]

Lindén

[11] Patent Number: 4,928,436

[45] Date of Patent: May 29, 1990

[54] DEVICE FOR SHARPENING KNIVES

[75] Inventor: Olavi Lindén, Billnäs, Finland

[73] Assignee: Fiskars Oy Ab, Helsinki, Finland

[21] Appl. No.: 297,964

[22] Filed: Jan. 17, 1989

[30] Foreign Application Priority Data

Jan. 20, 1988 [FI] Finland ..... 880233

[51] Int. Cl.[5] ..... B24B 7/08

[52] U.S. Cl. ..... 51/80 BS; 51/102; 51/208; 51/206 R; 51/99

[58] Field of Search ..... 51/80 BS, 81 BS, 82 BS, 51/91 BS, 92 BS, 102, 109 BS, 109 R, 285, 206, 209 R, 85 BS, 84 BS, 99, 114, 126, 208

[56] References Cited

U.S. PATENT DOCUMENTS

| | | | |
|---|---|---|---|
| 1,342,275 | 6/1920 | Cornell | 51/210 |
| 1,360,998 | 12/1920 | Barber | 51/208 |
| 1,591,469 | 7/1926 | Conn | 76/87 |
| 3,426,485 | 2/1969 | Yamaoka | 51/105 G |
| 3,461,616 | 8/1969 | Nissen et al. | 51/102 |
| 4,050,197 | 11/1977 | Thompson | 51/208 |
| 4,338,748 | 7/1982 | Elbel | 51/206 R |

*Primary Examiner*—Frederick R. Schmidt
*Assistant Examiner*—Mark F. Frazier
*Attorney, Agent, or Firm*—Foley & Lardner

[57] ABSTRACT

The object of the invention relates to a device for sharpening knives, comprising a freely rotatably mounted grinding element (6) consisting of two truncated cones turned against each other. In known devices of this kind, one side of the knife blade (17) remains unground at the free end and handle end of the blade. This can be avoided, if the grinding element (6) can turn around one end (11) of its axle (10) in such a way that the axle forms an angle with respect to the sharpening direction of the knife, which angle is smaller or larger than 90° in the end positions of the axle.

17 Claims, 2 Drawing Sheets

DEVICE FOR SHARPENING KNIVES

Figure 1:
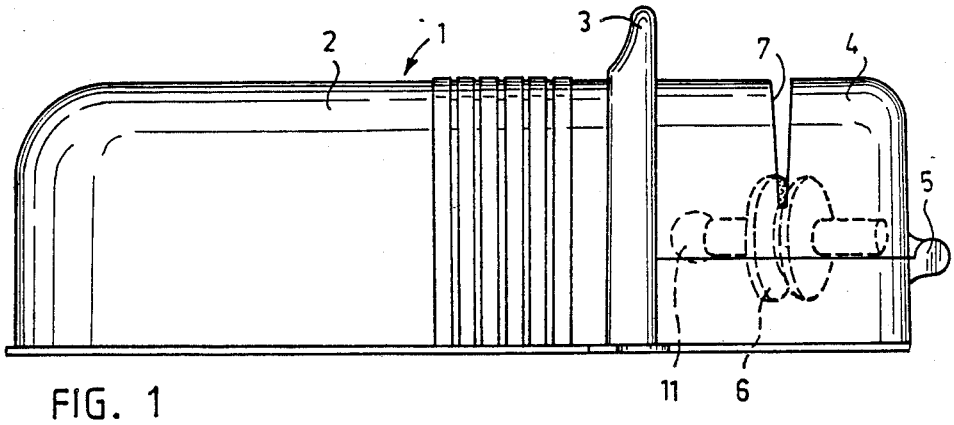

The present invention relates to a device for sharpening knives, comprising a frame, a grinding element freely rotatably mounted on an axle of the frame, which grinding element consists of two truncated cones, the axles of which are turned 180° in relation to each other, and a means arranged in said frame for steering the knife in the sharpening direction, whereby the grinding element is pivotally mounted between two end positions.

A sharpening device of this kind is previously known from GB-A-2 185 919. The particularly advantageous feature of the device according to said publication is that it sharpens the knife blade in such a way that the edge gets convex sides, which smoothly adjoin the sides of the blade. The edge angle can then be made larger than at edges with plane sides, which is advantageous for many uses and improves the durability of the edge. The convex form of the sides of the edge is provided by making the conical grinding surfaces wave-shaped so that the angle between the grinding surfaces seen in the sharpening direction of the knife varies while the grinding element is rotating. When the angle is large, the surfaces close to the verge of the edge are ground with a fine grinding surface, and when the angle is small, knife portions situated at a distance from the knife edge bear against the grinding surfaces, which within the area of the small angle are rough. Consequently, during a one-way motion of the knife, portions of the sides of the knife blade situated close to the edge and those situated at a distance from the edge are treated alternately.

It has appeared that this known construction has certain drawbacks. When sharpening a knife, it is possible that the same place on the grinding surface always grinds the same place on the knife when the knife is moved back and forth over the grinding element. Due to this certain portions of the knife are always ground close to the edge and other portions always at a distance from the edge, which naturally results in an unevenly sharpened knife.

Another drawback having a detrimental effect on the sharpening result is caused by the fact that the grooves in the sides of the knife caused by the grains of the grinding surfaces always are parallel. It is generally known that a more effective grinding and sharper edges are achieved, if the grooves cross each other.

A third drawback consists of that the device sharpens the free end and the handle end of the knife blade only on one side.

From the Patent No. SE-322 709 a sharpening device is known, in which the grinding element is mounted to be pivoted between two end positions, whereby the grinding element is automatically adjusted in such a way that its axle always is perpendicular to the knife. The device comprises no means for steering the knife in a certain direction during sharpening.

The object of the present invention is to provide a device for sharpening knives securing an even and effective sharpening of both sides of the knife over its whole length. The device according to the invention is characterized in that the grinding element is pivotally mounted between two end positions, the grinding element being pivoted around one end of its axle, which in said end positions forms angles with respect to the sharpening direction of the knife, which angles are smaller and larger, respectively, than 90°.

On account of the fact that the grinding element can be turned around one end of its axle in such a way that it can take two differently oblique end positions with respect to the sharpening direction, it is secured that a relative displacement takes place between the grinding surfaces and the knife blade, by what means it is to be avoided that same portions of the knife blade always are ground in the same way. The new way of grinding leads also to the fact that the grooves in the knife blade caused by the grinding particles cross each other and that both sides of the blade are sharpened to both ends of the blade.

An advantageous embodiment of the device according to the invention is characterized in that the angles by which the axle differs from the angle of 90° are with respect to the sharpening direction of the knife unequal in size and that the grinding surfaces of the grinding element have two concentric grinding zones, of which the inner grinding zone situated closest to the axle has a fine surface and the outer grinding zone has a rough surface.

This embodiment has the great advantage that it enables a convex sharpening of the sides of the knife blade in such a way that it is not necessary to make the grinding surfaces wave-shaped. This is due to the fact that in the end position in which the deviation from a right angle is smaller, the angle between the grinding surfaces seen in the sharpening direction is larger than in the end position in which the deviation from the right angle is larger. Consequently, the knife is situated at different distances from the axle of the grinding element in the two end positions, and thus, it is possible to grind different portions of the knife blade with grinding surfaces of different roughness. It is considerably simpler and cheaper to manufacture smooth conical grinding elements than waved ones. Considering that the grinding surface preferably shall wear to the same extent along its whole width, it is preferable that the inner and outer grinding zones have the same width.

Figure 2:
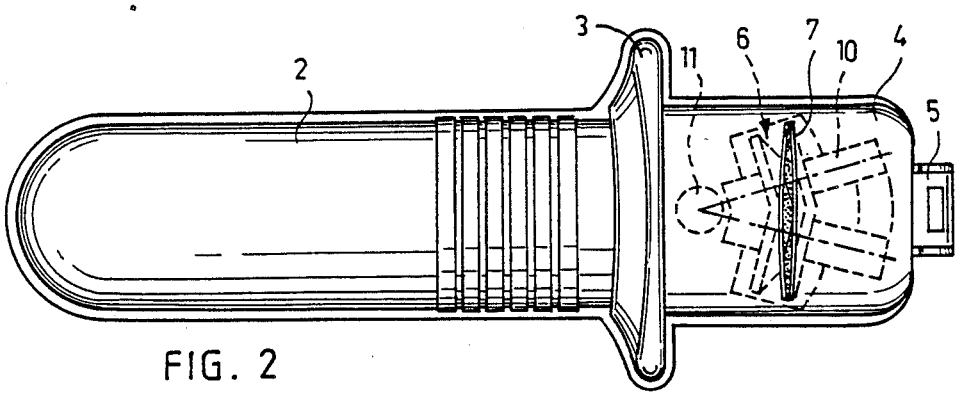
Figure 3:
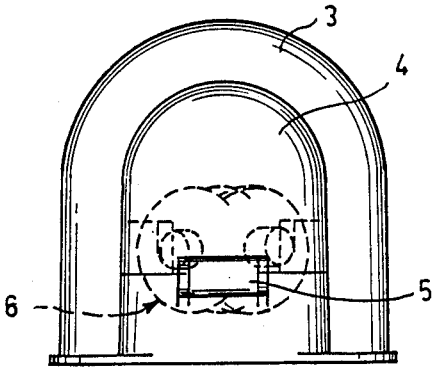
Figure 4:
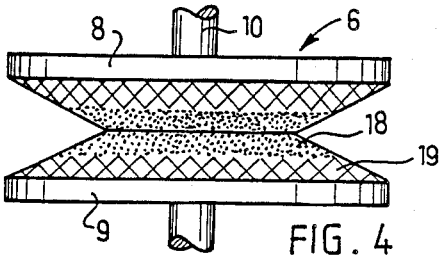
Figure 5:
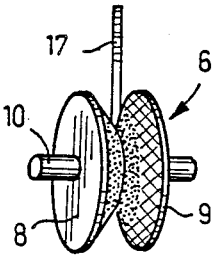
Figure 6:
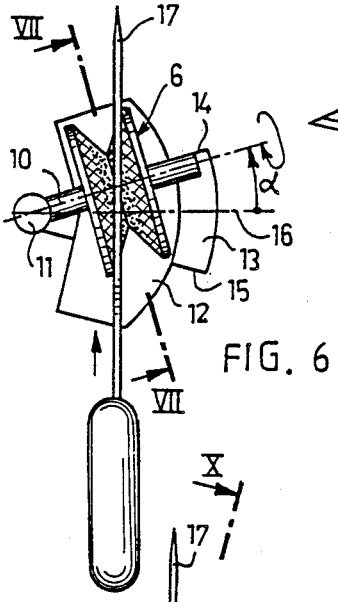
Figure 7:
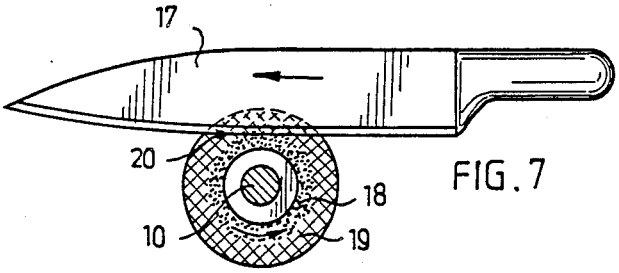
Figure 8:
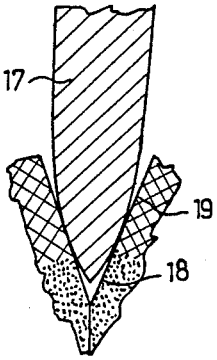
Figure 11:
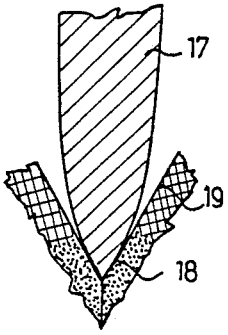
Figure 9:
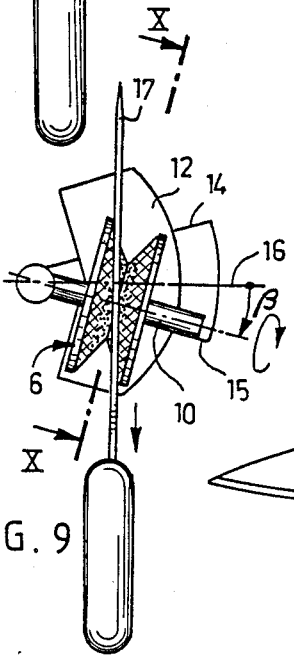
Figure 10:
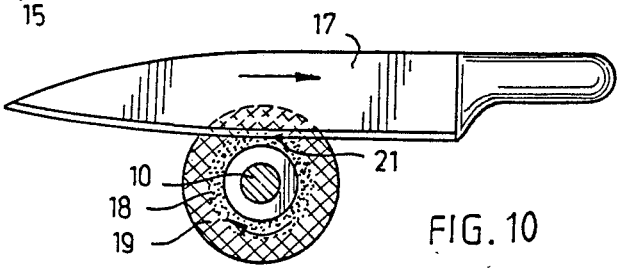

In the following, a preferred embodiment of the device of the invention is described in more detail with reference to the drawing enclosed, in which FIGS. 1–3 show a side, planar and end view the sharpening device of the invention, FIG. 4 shows a side view of a grinding element, FIG. 5 shows the grinding element seen in the sharpening direction, FIGS. 6–8 show different views of sharpening the knife, when the knife is moved forward and FIGS. 9–11 show the sharpening of the knife, when the knife is moved backward.

The sharpening device shown in the FIGS. 1–3 comprises an elongated frame 1 of a rigid plastic. The frame consists of a handle part 2, a protective collar 3 and a grinding part 4 provided with an ear 5 with an opening for suspension of the device on a hook or the like.

A grinding element 6 is arranged within the grinding part and the grinding part has a slit 7, which makes it possible for the knife to bear against the grinding element and which slit extends across the frame. The grinding element 6 consists of two wheels 8 and 9, see FIG. 4, in the form of truncated cones, the small bases of which bear against each other, i.e. the cone axles are turned 180° in relation to each other. The grinding element is preferably manufactured of a ceramic material, e.g. aluminium oxide or wolfram carbide, or of metal. The grinding element has an axle 10, both ends of which are mounted in the frame in such a way that the grinding element can rotate freely around the axle.

According to the invention, the axle 10 of the grinding element is arranged in the grinding part of the frame in such a way that it can pivot or turn around its one end 11 in a plane substantially parallel with the sharpening direction of the knife and perpendicular to the plane of the knife blade. The plane is also parallel with the bottom of the frame. The lower part of the grinding element is situated in the grinding part of the frame, in a U-shaped recess 12 when seen from above, see the FIGS. 6, 9. The concave long side of the recess shows a protrusion for the end 11 of the axle and the convex long side of the protrusion has a protrusion 13 enabling the axle to pivot around the end 11. End surfaces 14 and 15 of the protrusion 13 restrict the pivot motions of the axle, and thus, the axle is in an end position when bearing against one of the end surfaces 14, 15.

According to a preferable embodiment of the invention shown in the figures, the end surfaces 14, 15 of the protrusion 13 are situated in such a way that the angles between them and a straight line drawn through the turning centre of the axle 10 and being perpendicular to the sharpening direction of the knife are of different sizes. In the embodiment according to the figures, the angle $\alpha$ between the end surface 14 and said line 16 is larger than the angle $\beta$ between the end surface 15 and the line 16. In the FIGS. 6 and 9, $\alpha$ is appr. 15° and $\beta$ appr. 12°, but these angles can vary depending e.g. on the form of the grinding element. Consequently, the angle $\alpha$ can be between 5° and 25° and $\beta$ between 2° and 22°. In FIG. 6, the angle between the knife 17 and the axle 10 is appr. 105°, and in FIG. 9, appr. 78 °.

The grinding surfaces of the grinding element 6 have two concentric grinding zones, of which the inner grinding zone 18 situated close to the axle has a fine surface and the outer grinding zone 19 has a rough surface. The grinding zones have preferably the same width.

For sharpening a knife 17, the knife blade is brought with the edge downwards into the slit 7, whereby the blade bears against the grinding surfaces of the grinding element 6. If the knife is at first moved onwards according to the FIGS. 6–8, the axle 10 turns to contact with the end surface 14, which is situated at a longer distance from the line 16 than the end surface 15. Then, the angle between the grinding surfaces gets small seen in the knife direction, see FIG. 8, whereby the knife bears against the rough grinding zone 19 and the grinding takes place at a distance from the edge of the knife blade. In FIG. 7, the contact point between the knife and the grinding surface is indicated by the reference numeral 20.

When the knife after this is moved backwards according to the FIGS. 9–11, the axle 10 turns into contact with the end surface 15. Because the angle $\beta$ is smaller than the angle $\alpha$, the angle between the grinding surfaces seen in the knife direction gets larger than in the previous case and the knife will therefore lie closer to the axle 10, see FIG. 11. The knife then bears against the grinding zone 18, the surface of which consists of relatively small grinding particles working both sides of the knife edge. The contact point of the knife and the grinding zone 18 is indicated by the reference numeral 21 in FIG. 10.

By means of the device described above, it is thus possible to provide an even and effective grinding of the knife along its whole length in a simple way.

If a convex form is not desired for the side surfaces of the knife according to the FIGS. 8, 11, the angles $\alpha$ and $\beta$ can be equally large and the grinding surfaces can have the same roughness all over the surface. The slit 7 can be replaced by some other suitable means for steering the knife and the form of the frame 1 can differ substantially from what is shown in the FIGS. 1–3.

I claim:

1. A device for sharpening knives, comprising a frame, a grinding element freely rotatably mounted on an axle of the frame, which grinding element consists of two truncated cones, the axles of which are turned 180° in relation to each other, and a means arranged in said frame for steering the knife in the sharpening direction, whereby the grinding element is pivotally mounted between two end grinding positions, the grinding element being pivoted around one end of its axle, which in said end grinding positions forms angles with respect to the sharpening direction of the knife, which angles are smaller and larger, respectively, than 90°.

2. A device according to claim 1, wherein the angles ($\alpha$, $\beta$) by which said axle differs from the angle of 90° with respect to the sharpening direction of the knife are unequally large and the grinding element is provided with grinding surfaces having two concentric grinding zones, the inner grinding zone situated closest to the axle having a fine surface and the outer grinding zone having a rough surface.

3. A device according to claim 2, wherein said inner and outer grinding zones have the same width.

4. A device according to claim 1, wherein said means for steering the knife comprises a U-shaped recess formed in said frame defining a path of travel for said grinding element.

5. A device according to claim 4, wherein said recess includes a protrusion having end walls defining said two end positions.

6. A device according to claim 5 wherein said grinding element is pivotally mounted on an axis disposed perpendicular to the bottom of said frame.

7. A knife sharpener comprising:

means for steering said knife along a predetermined knife path;

a rotatable grinding element, comprising first and second opposed truncated cones having a common axis;

said grinding element being disposed for rolling movement between predetermined first and second end positions, such that said knife path passes between said cones, presenting a portion of one side of a knife steered along said path for contact with said first cone and a portion of the other side of said knife for contact with said second cone;

said grinding element axis being at a first angle of less than 90 degrees with respect to said knife path with said grinding element in said first end position; and said grinding element axis being at a second angle of more than 90 degrees with respect to said knife path with said grinding element in said second end position.

8. The knife sharpener of claim 7 wherein the magnitude of the angle between the grinding element axis and the perpendicular to said knife path with said grinding element in said first end position is unequal to the magnitude of the angle between the grinding element axis and the perpendicular to said knife path with said grinding element in said second end position.

9. The knife sharpener of claim 8 wherein the angle between the grinding element axis and the perpendicular to said knife path with said grinding element in said first end position is between 2 and 22 degrees and the angle between the grinding element axis and the perpendicular to said knife path with said grinding element in said second end position is between 5 and 25 degrees.

10. The knife sharpener of claim 7 wherein said first angle is approximately 78 degrees and said second angle is approximately 105 degrees.

11. The knife sharpener of claim 7 including means for effecting convex sharpening of said knife.

12. The knife sharpener of claim 7 wherein said cones each include at least an inner and outer grinding zone concentric about said axis, the inner zone having a relatively fine surface and the outer zone having a relatively rough surface.

13. Apparatus for sharpening a blade comprising:

a rotatable grinding element comprising first and second opposed trunciated cones with a common axis;

means for defining a blade path; and means for disposing said grinding element for interaction with a blade steered along said path, with said first cone on one side of said path and said second cone on the other side of said path, and constraining said grinding element for rolling movement between predetermined first and second end positions, said grinding element axis being at an angle of less than 90 degrees relative to said blade path with said grinding element in said first end position and said grinding element axis being at an angle of more than 90 degrees relative to said blade path with said grinding element in said second end position.

14. Apparatus of claim 13 wherein each of said cones is provided with a first grinding zone having a fine surface and a second grinding zone having a rough surface, said first grinding zones disposed opposite and coextensive each other and said second grinding zones disposed opposite and coextensive each other.

15. Apparatus of claim 14 wherein said blade is disposed against said rough surface with said grinding element in said first end position and against said fine surface with said grinding element in said second end position.

16. A method of sharpening a blade evenly, employing a rotatable grinding element comprising first and second opposed truncated cones with a common axis, said method comprising the steps of:

defining a blade path;

disposing said grinding element for interaction with a blade steered along said path, with said first cone on one side of said path and said second cone on the other side of said path;

constraining said grinding element for rolling movement between predetermined first and second end positions, said grinding element axis being at an angle of less than 90 degrees relative to said blade path with said grinding element in said first end position and at an angle of more than 90 degrees relative to said blade path with said grinding element in said second end position; and effecting said rolling movement of said grinding element between said first and second end positions by steering said blade along said path with said blade in contact with said grinding element.

17. The method of claim 16, including the steps of moving the blade forwardly to position said grinding element into said first end position such that said blade will contact a first grinding zone on each of said cones, and moving said blade rearwardly to position said grinding element into said second end position such that said blade will contact a second grinding zone on each of said cones.

* * * * *